US011925261B2

(12) United States Patent
Scow et al.

(10) Patent No.: US 11,925,261 B2
(45) Date of Patent: Mar. 12, 2024

(54) FURNITURE PIECE WITH PLASTIC SPACERS FOR DRAWER SLIDES

(71) Applicant: ASHLEY FURNITURE INDUSTRIES, LLC, Arcadia, WI (US)

(72) Inventors: Bruce Scow, Whitehall, WI (US); Eric Kramer, Winona, MN (US)

(73) Assignee: ASHLEY FURNITURE INDUSTRIES, LLC, Arcadia, WI (US)

( * ) Notice: Subject to any disclaimer, the term of this patent is extended or adjusted under 35 U.S.C. 154(b) by 157 days.

(21) Appl. No.: 17/430,300

(22) PCT Filed: Feb. 11, 2020

(86) PCT No.: PCT/US2020/017738

§ 371 (c)(1),
(2) Date: Aug. 11, 2021

(87) PCT Pub. No.: WO2020/167823

PCT Pub. Date: Aug. 20, 2020

(65) Prior Publication Data

US 2022/0192375 A1 Jun. 23, 2022

Related U.S. Application Data

(60) Provisional application No. 62/804,039, filed on Feb. 11, 2019.

(51) Int. Cl.
*A47B 88/43* (2017.01)

(52) U.S. Cl.
CPC ..... *A47B 88/43* (2017.01)

(58) Field of Classification Search
CPC ..... A47B 88/43; A47B 88/423
See application file for complete search history.

(56) References Cited

U.S. PATENT DOCUMENTS 913,228 A * 2/1909 McCarthy ..... B61D 37/003 224/29.5
3,038,774 A * 6/1962 Cyrus ..... A47B 88/43 312/350
4,137,115 A 1/1979 Lambert
4,681,289 A * 7/1987 Gronlund ..... A47B 88/43 248/224.8

(Continued)

FOREIGN PATENT DOCUMENTS

JP 2008012014 A * 1/2008 ..... A47B 57/40

OTHER PUBLICATIONS

International Search Report for Application No. PCT/US2020/017738 dated Jun. 8, 2020, 3 pages.

*Primary Examiner* — Hanh V Tran
(74) *Attorney, Agent, or Firm* — Christensen, Fonder, Dardi & Herbert PLLC

(57) ABSTRACT

A molded plastic spacer for securing a drawer slide to a cabinet panel. The plastic spacer may have one or more lugs extending orthogonally from a cabinet panel contact face and configured to interface with corresponding recesses in the cabinet panel. The one or more lugs may further include a tapered central bore capable of receiving a pin. Driving the pin through the bore causes the lug to expand such that a ribbed exterior surface of the lug engages with the cabinet panel and secures the plastic spacer in place. Each of the one or more lugs having space above the respective pin for robotically driving the pin.

17 Claims, 9 Drawing Sheets

(56) References Cited

U.S. PATENT DOCUMENTS 4,753,405 A * 6/1988 Camilleri ..... A47B 96/061 108/134
5,039,181 A * 8/1991 Lautenschlager ..... A47B 88/43 312/334.7
5,457,867 A * 10/1995 Maberry ..... A47B 88/43 29/525.04
5,562,333 A * 10/1996 Domenig ..... A47B 88/43 312/348.1
5,597,220 A * 1/1997 Domenig ..... A47B 88/43 312/334.7
5,669,108 A * 9/1997 Ferrari ..... A47B 88/43 16/383
5,671,986 A * 9/1997 Vinet ..... A47L 15/507 312/334.21
5,823,648 A 10/1998 Domenig
6,312,186 B1 * 11/2001 Rock ..... F16B 12/34 403/353
7,090,320 B2 8/2006 Chen et al.
10,299,586 B1 * 5/2019 Powwarynn ..... A47B 88/423
2004/0068834 A1 * 4/2004 Salice ..... A47B 88/43 16/94 R
2004/0224086 A1 11/2004 Wright
2005/0077805 A1 4/2005 Dalebout et al.
2005/0122015 A1 * 6/2005 Hightower ..... A47B 67/04 312/334.5
2006/0226748 A1 10/2006 Kinsel et al.
2007/0247043 A1 * 10/2007 Simmons ..... A47L 15/0084 312/334.1
2009/0261698 A1 * 10/2009 Cabal Velarde ..... A47B 88/493 312/334.1
2013/0153722 A1 * 6/2013 Larkin ..... A47B 88/40 248/221.11
2015/0022071 A1 * 1/2015 Chen ..... G07F 11/04 312/334.8
2015/0211574 A1 * 7/2015 Chen ..... A47B 88/487 384/49
2015/0375686 A1 * 12/2015 George ..... B60R 9/02 248/220.21
2018/0242736 A1 * 8/2018 Duggins ..... A47B 88/407
2018/0295988 A1 * 10/2018 Harder ..... A47B 88/407

* cited by examiner

FURNITURE PIECE WITH PLASTIC SPACERS FOR DRAWER SLIDES

CROSS-REFERENCE TO RELATED APPLICATION

The present application is a National Phase entry of PCT Application No. PCT/US2020/017738, filed Feb. 11, 2020, which claims the benefit of U.S. Provisional Application No. 62/804,039, filed Feb. 11, 2019, the entire contents of which are incorporated by reference herein.

FIELD OF THE DISCLOSURE

The present disclosure relates to affixing drawers to cabinets. More specifically, the present disclosure relates to an apparatus to offset a guide rail from a cabinet panel.

BACKGROUND

Drawers are typically slidingly affixed to interior side panels of a cabinet using drawer slides. A drawer slide comprises a guide rail and a slide. The guide rails are typically screwed to the interior surfaces of panels of the cabinet and configured to receive the slides. A slide is typically screwed to the exterior surface of each of the drawer's two side panels. When the slides are engaged with the corresponding rails, a user may easily slide the drawer in and out of the cabinet.

SUMMARY

Assembly of furniture components has become more automated utilizing industrial robots to accomplish assembly steps that previously were done manually. Particularly steps such as sawing, drilling holes and otherwise shaping the wood or wood based components; adding glue, placing and aligning components, and driving fasteners such as staples, are amenable to automated robotic assembly. Driving screws for assembly of components can be problematic.

Assembly of furniture known as case goods that have drawers, such as chests of drawers, may conveniently utilize drawer slides. Such furniture pieces require attachment of the rails to wood or wood product structural panels of the furniture item. A common configuration has the width of the drawer sized to the distance between the two cabinet side panels allowing the rails to be attached to the side panels. Where the cabinet side panels are offset from drawers, assembly of the furniture piece requires attaching the rails to front and rear panels or to bridge the offset distance from the side panels with spacers. The spacers that extend from the side walls are designed as cantilever structures that must accommodate the loading of the drawer and all contents. Depending on the application, this may be minimal weight such as where there is a drawer with minimal depth for miscellaneous non clothing items, or it may necessary to carry significant weight where the drawer depth is deeper, for example four or more inches, and the furniture piece will be holding heavy clothing or other heavier things. The loading on such spacers creates a downward force and a moment that must be accommodated by the spacer and by the spacer panel connection. Current spacers are polymer and are configured as shown in Prior Art FIG. 3. The panels that receive such spacers have two holes predrilled with a diameter of about 7.5 mm and with a center to center spacing of 64 mm. The spacer has a body with a flange on one end that contacts the inside surface of the side panel and an opposite rail attachment end with a screw receiving boss. The flange has two solid non-expandable lugs with circumferential ribbing, each solid lug is slightly oversized with respect to the panel hole diameter, for example about 8.2 mm, are spaced center to center on the flange at 64 mm, and are received in the panel holes in an interference fit. The flange has two holes on opposite ends of the flange, distal from the solid lugs, for receiving screws. The spacer is manually hammered into the wall panel and then screws are manually inserted through the flange holes into the panel. The two holes in the flange have clearance above them, with respect to the spacer body, allowing the assembler to easily access and drive the screw. Glue is typically applied to the predrilled holes prior to insertion of the solid non-expandable lugs. These spacers and the manual assembly method have proved more than adequate for supporting drawers in such furniture pieces. However, it would be very advantageous to minimize the manual labor and otherwise simplify assembly steps.

Expandable polymer split lugs are known for use in attachment of shelving components and the like to drywall surfaces. A small hole, for example 2 to 4 mm, is predrilled into the drywall and a split lug of the component is inserted into the hole, a lug expander with a shaft and head protruding from a central opening in the split lug is then driven into the center of the split lug forcing portions of the lug radially outward anchoring the split lug and component to the drywall. Where loads of any significance are to be carried, such as a closet shelf, the shelf is attached to the wall proximate the shelf level and then an angled support bracket extends from a distal portion of the shelf downwardly and inwardly to direct the load of the shelf into the wall. Due to the significant loads that may be carried by such shelves, the two wall connections will typically be vertically spaced about 25 cm or more inches apart.

A furniture item that is amenable to automated construction steps, has a cabinet portion with a plurality of stacked drawers therein, the cabinet formed of a pair of wood product side wall panels, a rear panel extending between the side wall panels, and a front panel with openings that receive the plurality of stacked drawers. Each of the plurality of drawers having a pair of drawer slides attaching the respective drawer to the pair of side panels by way of a polymer cantilever spacer. Each drawer slide having a rail portion and a cooperating slide portion, the rail portions secured to the polymer cantilever spacers and the slide portion secured to the drawers. In embodiments, the polymer spacer comprising a body portion having a panel engagement end and an opposite rail attachment end. The spacer connecting with the panel side wall at the panel engagement end at least two connections. A rail attachment boss positioned at the rail attachment end of each spacer and a threaded member extending through an opening in a respective rail into the connection boss. A pair of oppositely extending flange pads or tabs unitary to the body portion are positioned at the first panel engagement end. The pads or tabs each having a planar engagement surface for engagement with the interior surface of the side wall panel and each having a split ribbed lug portion extending in a direction away from the body portion. The split ribbed lug portions each having a pre-insertion maximum diameter greater than 7 mm, an axis extending in a direction perpendicular to the planar engagement surfaces, a central opening extending through the respective flange tab into the split ribbed lug portion, the opening having an interior taper in the split ribbed lug portion. Each split ribbed lug portion having an elongate expander member in the opening which may be configured as a nail. The elongate expander having a shaft portion with a pointed end and having a head portion. Two connections of the at least two connections being defined by way of the split ribbed lug portions being inserted into corresponding holes in the respect side wall panels, the holes having a drilled diameter of the same as or less than the pre-insertion maximum diameter of the split ribbed lug portions. The lugs being radially clamped into the holes in the side wall panels by a full insertion of each expander into the openings of the respective split ribbed lug portions whereby the split portions are compressed between the expander and the interior surface of the side wall panel holes. In embodiments, the spacer body portion extending from the flange portion is spaced inwardly from the respective axis of the split ribbed lug portions by at least 4 mm. In embodiments, each spacer is connected to the respective side wall panel by only two connections. In embodiments each of the only two connections further comprises cured glue in the connection. In embodiments each spacer has at least one supplemental screw through the flange into the respective side wall panel. The inventor has determined that two connections with split ribbed lug portions as unitary parts of the spacers, and with the elongate expanders, surprisingly, are adequate for securing the drawer slides and drawers in manufactured furniture. Moreover, the spacers may be handled by automated means, including insertion into respective holes in the side wall panels, and the ribbed split lugs may be expanded and clamped into said holes by the same automated means. A feature and advantage of the invention is a spacer that has corresponding interface portions as a prior art spacer and is improved for handling.

In embodiments, a molded plastic spacer for securing a drawer slide to a cabinet panel in accordance with embodiments includes a cabinet panel contact face opposite a parallel drawer slide contact face. The panel contact face defined by a pair of coplanar flange tabs or pads including a lower flange tab and an upper flange tab (when mounted on the cabinet panel), unitary to a spacer body portion, the body portion including a boss for connection to a rail of the drawer slide by a threaded fastener. The body portion having a perimeter flange extending from the upper flange tab to the boss and then to the lower flange tab, the perimeter flange being continuous between and including the upper flange tab and the lower flange tab. A body portion webbing spans between the perimeter flange webbing and has one or more ribs or gussets unitary with the webbing. The perimeter flange has a sloped edge portion opposite an inset edge portion. In embodiments, an inside angle between the sloped facing edge portion of the body portion and the cabinet panel contact face of the flange tab portions is between 50 and 65 degrees. In embodiments, the angle between the outside surface of the sloped edge portion and the lower flange tab is between 120 and 130 degrees. In embodiments, an angle between the sloped edge portion of the body portion and the cabinet panel contact face is about 60 degrees. In embodiments, each of the lower flange tab and upper flange tab have unitary split ribbed lug portions extending perpendicular to the panel contact face and having a central opening that extends through the respective flange tab. The split ribbed lug portions having a plurality of legs, the legs defining in part the opening, the opening narrows in a direction away from the flange tab. Each split ribbed lug portion having an associated expander configured as a metal pin with a head thereon. The expander having a pre-clamp or pre-expansion position with the shaft extending away from the respective flange tab opposite the split ribbed lug portion and the head spaced from the flange tab. Each expander insertable into the opening to expand the split ribbed lug portion whereby the head confronts or engages the flange tab and the shaft extends fully into the opening to force the legs of the split ribbed lug portions radially outward.

In embodiments, a continuous support strip configured as a perimeter flange extends around the upwardly facing edge portion of the body portion, along the rail attachment portion and along the downwardly facing edge portion of the body portion. The support strip having a width that is uniform for the entire length of the support strip. In embodiments, the support strip is unitary with and has the same width as each of the flange tabs. In embodiments, the support strip and flange tabs have a uniform wall thickness. In embodiments the upwardly facing edge portion has an inset region and the downwardly facing edge portion is sloped. In embodiments the downwardly facing edge portion has an inset region and the upwardly facing edge portion is sloped.

In embodiments, the body portion comprises a pair of parallel gussets extending from the downwardly facing edge portion to the upwardly facing edge portion.

A first lug having a tapered central bore extends orthogonally from the cabinet panel contact face. A first lug is configured to interface with a corresponding recess in a cabinet panel. A pin is configured to be placed in a tapered central bore of the lug. Inserting the pin displaces an outside surface of the lug radially outward. Examples of pins for purposes of this disclosure may include any combination of nails, screws, pegs, rods, and the like. A hole in the drawer slide contact face is configured to receive a drawer slide mounting screw. In embodiments, the hole is defined in a boss that extends away from the drawer slide contact face.

In embodiments, the cabinet panel contact face includes a second lug and a second pin. In embodiments, the first lug and second lug are spaced between 50 and 80 millimeters from one another along the longitudinal axis. In embodiments, the first lug and second lug are spaced about 64 millimeters from one another along the longitudinal axis. In embodiments, the first lug is forward of the downwardly facing edge portion of the body portion. In embodiments, the second lug is rearward of the upwardly facing edge portion of the body portion. In embodiments, a lug height is between 5 and 20 millimeters. In embodiments, a lug height is about 10 millimeters. In embodiments, the second pin is positioned within the inset or recess defined by the upwardly facing edge portion of the body portion. In embodiments, the downwardly facing edge portion of the body portion defines a notch about the first pin.

In embodiments, the cabinet panel contact face defines a first aperture forward of the first lug configured to receive a screw. In embodiments, the cabinet panel contact face defines a second aperture reward of the upwardly facing edge portion of the body portion configured to receive a screw.

In embodiments, one or more structural ribs or gussets extend from the upwardly facing edge portion to the downwardly facing edge portion of the body portion. In embodiments, the one or more structural ribs have a thickness of between 2 and 4 millimeters. In embodiments, the flange tabs, the perimeter flange and the one or more structural ribs have a thickness of about 3 millimeters. In embodiments, the flange tabs, the perimeter flange and the one or more structural ribs have a thickness in the range of from 2 to 4 millimeters. In embodiments, an angle between the one or more structural ribs and the longitudinal axis of the cabinet panel contact face is between 40 and 60 degrees. In embodiments, an angle between the one or more structural ribs and the longitudinal axis of the cabinet panel contact face is about 50 degrees.

A feature and advantage is that spacers as described herein may be quickly and repeatedly installed by automation.

In embodiments, the molded plastic spacer has a height as measured from the cabinet panel contact face to the drawer slide contact face between 45 and 85 millimeters. In embodiments, the molded plastic spacer height is about 52 millimeters. In embodiments, the molded plastic spacer height is about 76 millimeters.

In embodiments, an axial length of the drawer slide contact face is between 20 and 45 millimeters. In embodiments, an axial length of the drawer slide contact face is about 24 millimeters. In embodiments, an axial length of the drawer slide contact fact is about 38 millimeters. In embodiments, an axial length of the cabinet panel contact face is between 80 and 120 millimeters. In embodiments, an axial length of the cabinet panel contact face is about 101 millimeters.

According to an embodiment, a method for installing a molded plastic spacer on a cabinet panel includes providing a molded plastic spacer; aligning the lug of the molded plastic spacer with a corresponding recess in the cabinet panel; inserting the lug into the corresponding recess in the cabinet panel; and driving the pin towards the cabinet panel. In embodiments, the method further includes providing a drawer slide; aligning an aperture of the drawer slide with the bore in the drawer slide contact face; and securing the drawer slide to the drawer slide contact face with fastening means.

A feature and advantage of embodiments is that a drawer slide contact face is directly above one of the two lugs positioned on two flange tabs. Provision for driving in the pin of the one of two lugs by a robotic hammer portion is provided by an inset in a perimeter flange extending between the two flange tabs and the drawer slide contact face.

A feature and advantage of the disclosure is a reduction of the number of fasteners required to secure a plastic spacer to a cabinet panel. A feature and advantage of the disclosure is the ability to offset drawer slides from a cabinet panel at various distances. A feature and advantage of the disclosure is the ability place and install the plastic spacer in a single motion. A feature and advantage of the disclosure is the ability to use automatic tooling for the placement and installation of the plastic spacer. A feature and advantage of the disclosure is a reduction of stress placed on the structure of the plastic spacer during installation. A feature and advantage of the disclosure is the interoperability of the plastic spacer with existing cabinet panels and drawer slides. A feature and advantage of the disclosure is that embodiments using nails or pins are less prone to damage cabinet panels than screws which can be overtightened and easily fracture the panels. A feature and advantage of the disclosure is the ability to create aesthetically pleasing cabinets by offsetting drawer slides such that drawers align with cabinet panels in a variety of designs.

The above summary is not intended to describe each illustrated embodiment or every implementation of the present disclosure.

DETAILED DESCRIPTION

Figure 1A:
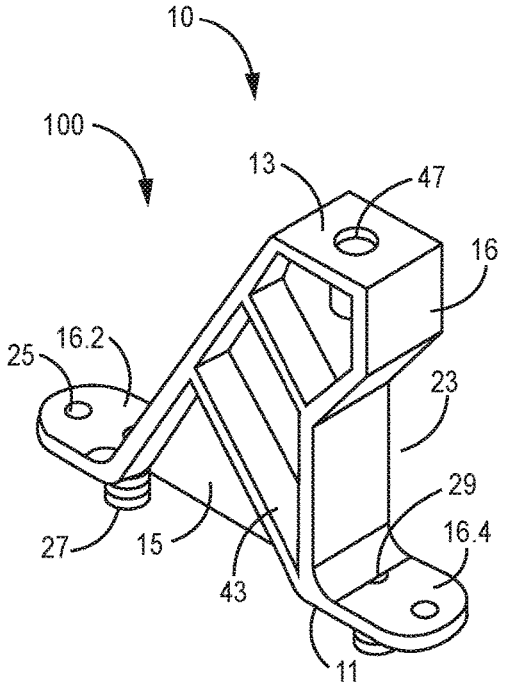
FIG. 1A is a perspective back view of a tall plastic spacer according to an embodiment of the disclosure.
Figure 1B:
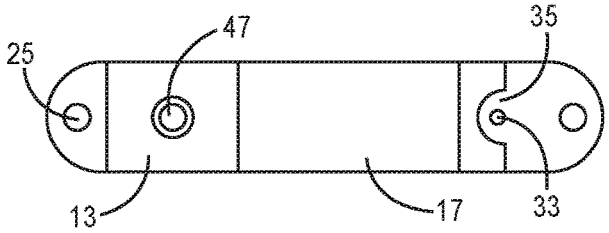
FIG. 1B is a top view of a tall plastic spacer according to an embodiment of the disclosure.
Figure 1C:
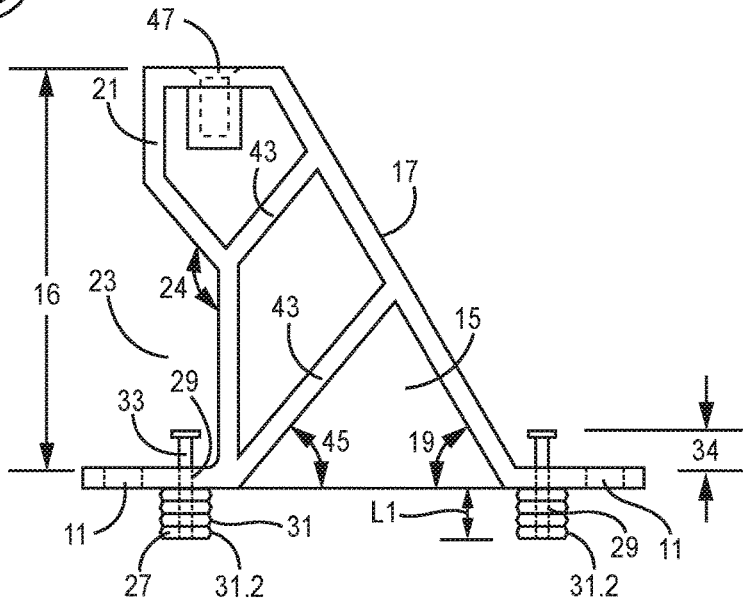
FIG. 1C is a side view of a tall plastic spacer according to an embodiment of the disclosure.
Figure 1D:
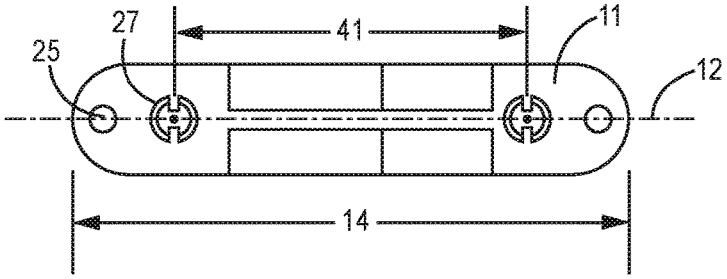
FIG. 1D is a bottom view of a tall plastic spacer according to an embodiment of the disclosure.
Figure 2A:
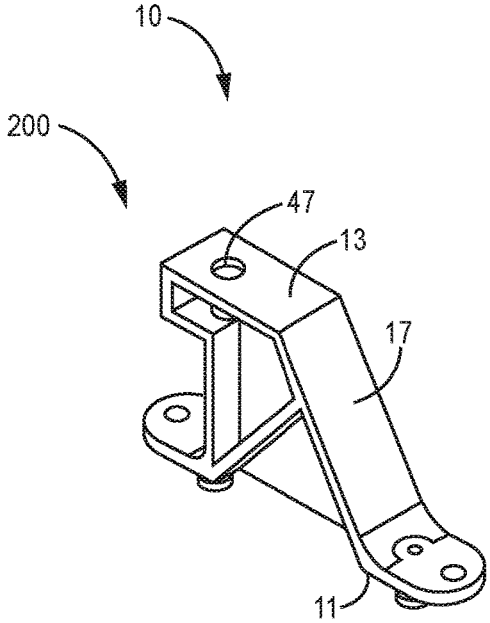
FIG. 2A is a perspective front view of a short plastic spacer according to an embodiment of the disclosure.
Figure 2B:
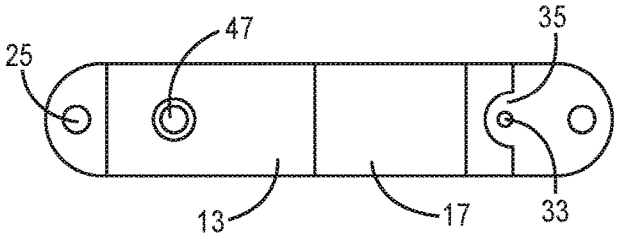
FIG. 2B is a top view of a short plastic spacer according to an embodiment of the disclosure.
Figure 2C:
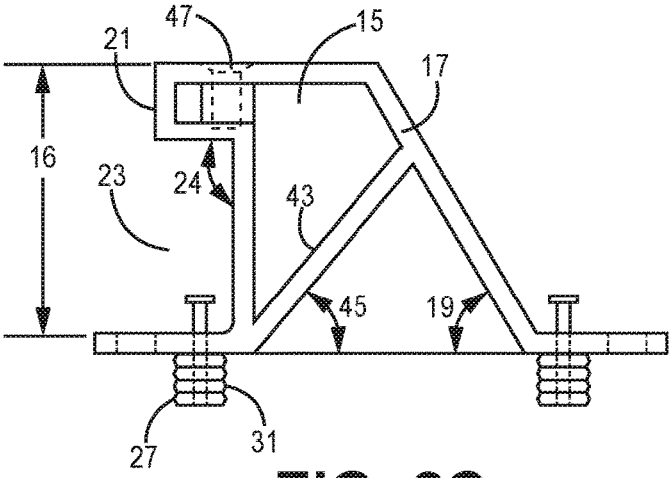
FIG. 2C is a side view of a short plastic spacer according to an embodiment of the disclosure.
Figure 2D:
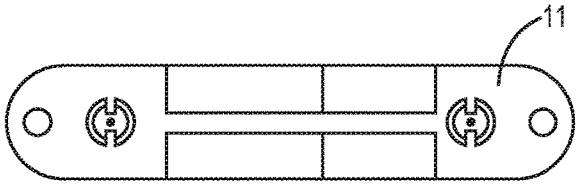
FIG. 2D is a bottom view of a short plastic spacer according to an embodiment of the disclosure.

FIGS. 1A-2D depict a plastic drawer slide spacer 10 according to embodiments of the disclosure. Referring to FIGS. 1A-1D, a tall plastic spacer 100 is illustrated having a cabinet panel contact face 11 with a longitudinal axis 12 opposite and parallel to a drawer slide contact face 13. The plastic spacer 10 has a body portion 15 that extends from the cabinet panel contact face 11 to the drawer slide contact face 13. The body portion 15 has an edge portion 16 configured as a perimeter flange extending from a first flange tab or pad 16.2 continuously about the body portion to a second flange tab or pad 16.4. A webbing 16.6 spans between the perimeter flange 16 on opposite sides of the spacer. The perimeter flange 16 has a sloped edge portion 17 that joins and is unitary with the flange pad 16.4 with the cabinet panel contact face 11 at an angle 19 between 50 and 65 degrees. In some embodiments, the sloped edge portion 17 forms an angle 19 of about 59.8 degrees with the cabinet panel contact face 11. In embodiments, the angle 19 is about 60 degrees. The body portion 15 includes an edge portion 21 opposite the sloped edge portion 17 that is inset and defines a recess 23. In embodiments, the recess 23 may have a profile that is generally "U" shaped. In embodiments, the recess 23 may have a wider opening than a "U" shape. For example, the recess 23 may define an angle that is between 89 and 181 degrees. In embodiments, the recess 23 may define a recess angle 24 that is about 141.5 degrees. In embodiments, the recess 23 may define a recess angle 24 that is about 90 degrees. The recess provides space for a hammer portion described below.

A lug 27 extends orthogonally outward from cabinet panel contact face 11. The lug 27 defines a tapered central bore 29 extending throughout and capable of receiving a pin 33. In embodiments, the lug 27 has a ribbed surface 31 defining outside edges 31.2. In embodiments, the ribbed surface 31 may include one or more notches which can act as a glue relief. In embodiments, the central bore 29 is widest at the cabinet panel contact face 11. In embodiments, the central bore 29 tapers from a diameter of about 2 millimeters down to a diameter of about 1 millimeter. A lug 27 length L1 may be between 5 and 20 millimeters. In some embodiments, a lug 27 length is about 10 millimeters. In embodiments, the length of the pin exceeds the length of the lug. Examples of a pin 33 for purposes of this disclosure may include any combination of nails, screws, bolts, pegs, rods, rivets, and the like. In embodiments, pin 33 is a nail. Pin 33 may be between 10 and 25 millimeters long. In embodiments, pin 33 is about 15 millimeters long. Pin 33 may have a head with a diameter of about 4.5 millimeters. The pin 33 has a starting configuration wherein the pin 33 is partially inserted into the central bore 29 such that a portion of the pin 33 remains exposed. In embodiments, a portion of pin 33 extends in a direction opposite the lug 27 by a pin offset 34 from the cabinet panel contact face when pin 33 is in the starting configuration. In embodiments, a pin offset 34 may be about 7 millimeters.

A first lug 27 may be positioned axially forward of the sloped edge portion 17. A notch 35 may be formed in the sloped edge portion 17 to permit access to the central bore 29. A second lug 27 may be positioned axially rearward of the upwardly facing edge portion 21. In embodiments, the central bore 29 of the second lug 27, and a corresponding second pin 33 are located within recess 23. The first and second lug 27 may have an axial separation 41 of between 50 and 80 millimeters. In embodiments, the first and second lug 27 have an axial separation 41 about 64 millimeters.

The cabinet panel contact face 11 may have an axial length 14 of between 80 and 120 millimeters. In embodiments, the cabinet panel contact face 11 has an axial length 14 of about 101 millimeters. The cabinet panel contact face 11 may have an aperture 25 axially forward of the first lug 27 configured to receive a fastener. The cabinet panel contact face 11 may have an aperture 25 axially rearward of the second lug 27 configured to receive a fastener. Examples of fasteners for purposes of this disclosure may include any combination of welds, rivets, screws, nails, lugs, bolts, glue, and the like in addition to associated components such as washers or nuts.

A plastic spacer 10 may have one or more structural ribs 43 or gussets extending between the upwardly facing edge portion 21 and the sloped edge portion 17. The one or more structural ribs 43 may form a rib angle 45 between 40 and 60 degrees with respect to the cabinet panel contact face 11. In embodiments, one or more structural ribs 43 forms a rib angle 45 of about 50.2 degrees with respect to the cabinet panel contact face 11.

A tall plastic spacer 100 may have a height 16 between the cabinet panel contact face 11 and the drawer slide contact face 13 of between 65 and 85 millimeters. In embodiments, a tall plastic spacer 100 has a height 16 of about 76 millimeters. A drawer slide contact face 13 of a tall plastic spacer 100 may have an axial length between 28 and 45 millimeters. In embodiments, a drawer slide contact face 13 of a tall plastic spacer 100 has an axial length of about 38 millimeters. A drawer slide contact face 13 may include a bore 47 configured to receive a fastener. In embodiments, the bore 47 is countersunk.

One skilled in the art will appreciate that a plastic spacer 10 may be manufactured through known methods such as injection molding. Common materials for injection molded components include thermoplastics and thermosetting polymers. Although plastics are referenced, other materials or combinations of materials are not beyond the scope of this scope of this disclosure. For example, a plastic spacer 10 may comprise a metallic body portion 15 and a plastic lug 27.

Referring to FIGS. 2A-2D, a short plastic spacer 200 is illustrated having a cabinet panel contact face 11 opposite and parallel to a drawer slide contact face 13. The short plastic spacer 200 has a body portion 15 that extends from the cabinet panel contact face 11 to the drawer slide contact face 13. The body portion 15 has a sloped edge portion 17 that intersects the cabinet panel contact face 11 at an angle 19 between 50 and 65 degrees. In some embodiments, the sloped edge portion 17 forms an angle 19 of about 59.8 degrees with the cabinet panel contact face 11. The body portion 15 includes a upwardly facing edge portion 21 that defines a recess 23.

In embodiments, a short plastic spacer 200 has a height 16 between the cabinet panel contact face 11 and the drawer slide contact face 13 of between 45 and 65 millimeters. In embodiments, a short plastic spacer 200 has a height 16 of about 52 millimeters. In embodiments, a drawer slide contact face 13 of a short plastic spacer 200 has an axial length between 20 and 28 millimeters. In embodiments, a drawer slide contact face 13 of a short plastic spacer 200 has an axial length of about 24 millimeters. In embodiments, a drawer slide contact face 13 has a bore 47 configured to receive a fastener. In embodiments, the bore 47 is countersunk.

Figure 3A:
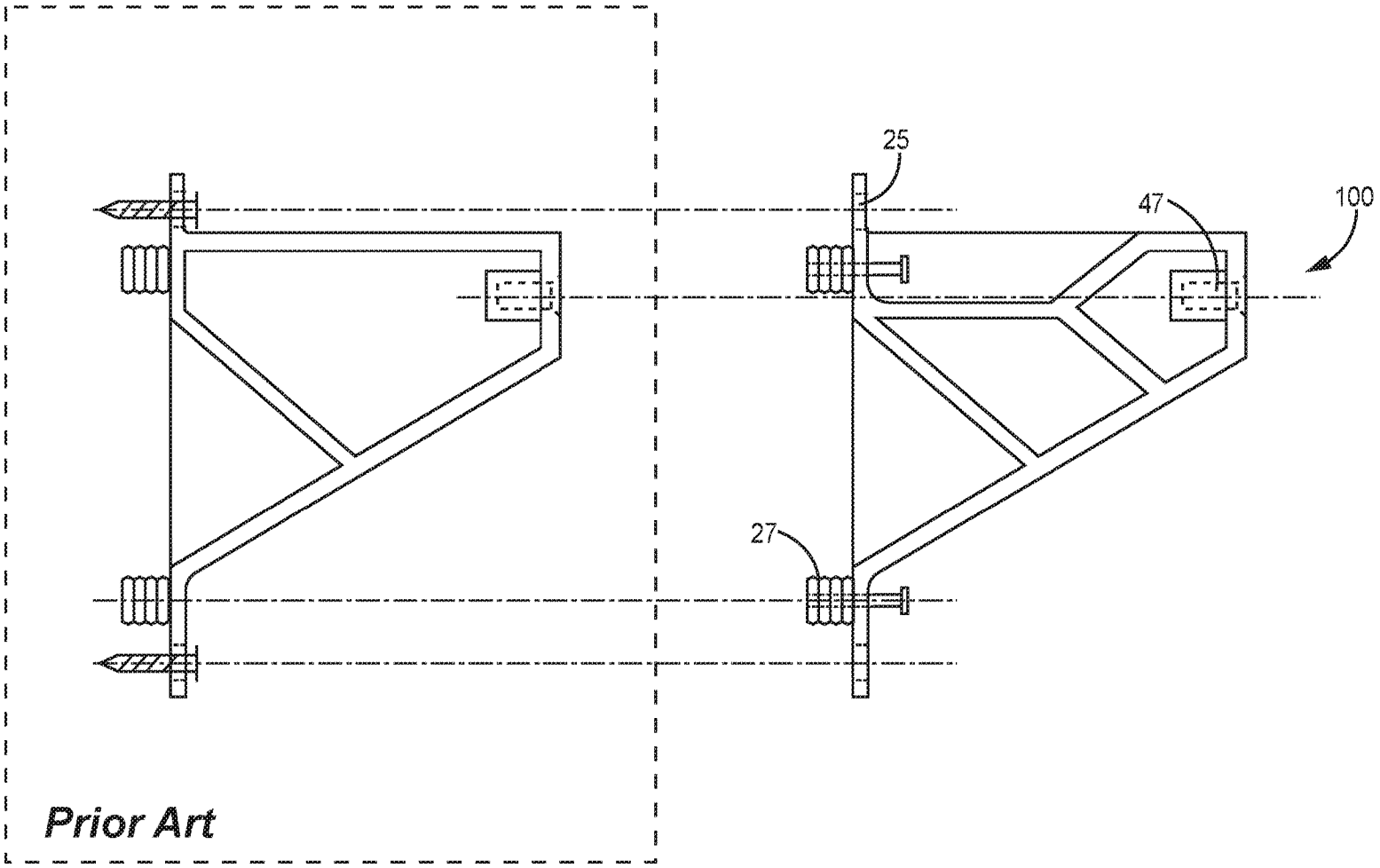
FIG. 3A is a comparison of the side view of a tall plastic spacer according to an embodiment of the disclosure with corresponding prior art.

FIG. 3A illustrates a comparison of a tall plastic spacer 100 with a similarly scaled piece of prior art. The tall plastic spacer 100 and the prior art both contain connection points including a lug 27, an aperture 25 and a bore 47. As illustrated in FIG. 3A, the connection points of the tall plastic spacer 100 generally axially align with the corresponding connection points as shown in the prior art. Additionally, a tall plastic spacer 100 has a similar height 16 to the prior art. As such, an installer is able to utilize a tall plastic spacer 100 in place of the prior art, and gain some of its advantages, without the requirement of changing any other aspect of the installer's other components or parts.

Figure 3B:
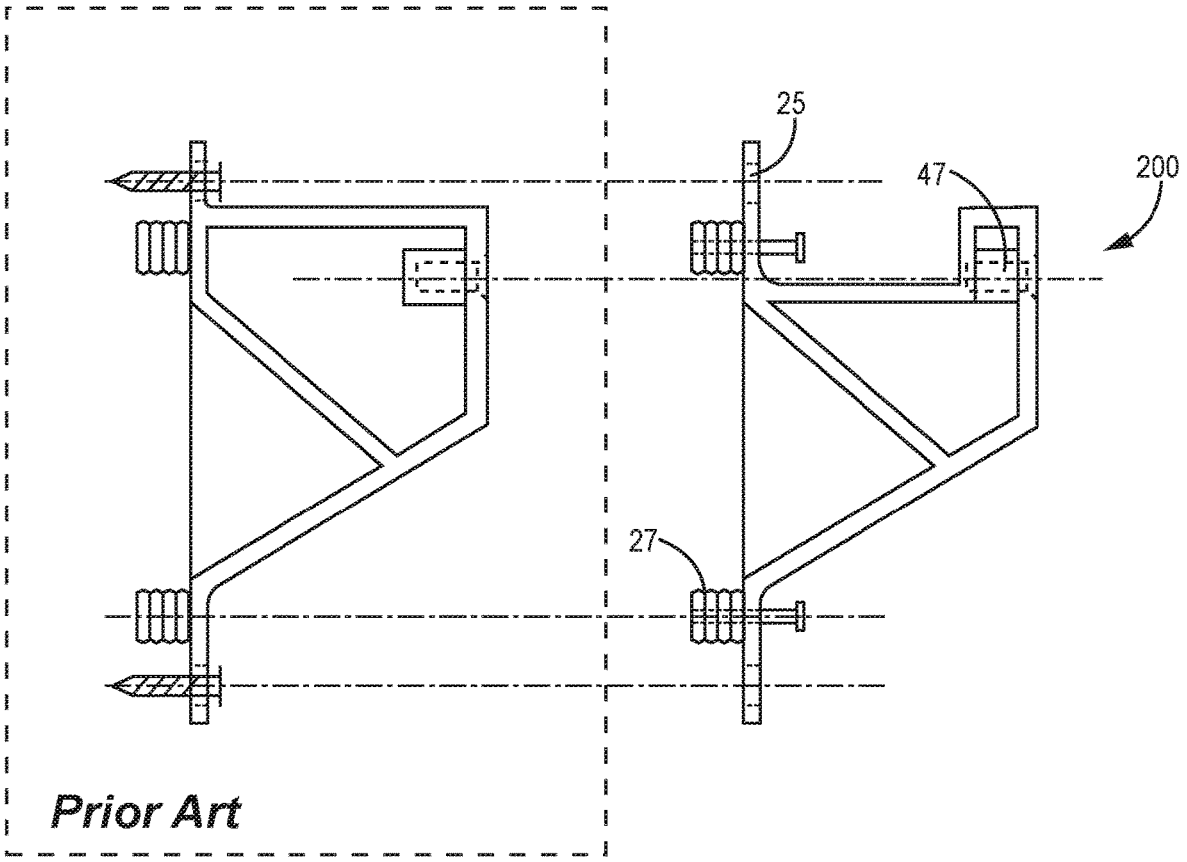
FIG. 3B is a comparison of the side view of a short plastic spacer according to an embodiment of the disclosure with corresponding prior art.

FIG. 3B illustrates a comparison of a short plastic spacer 200 with a similarly scaled piece of prior art. The short plastic spacer 200 and the prior art both contain connection points including a lug 27, an aperture 25 and a bore 47. As illustrated in FIG. 3B, the connection points of the short plastic spacer 200 generally axially align with the corresponding connection points as shown in the prior art. Additionally, a short plastic spacer 200 has a similar height to the prior art. As such, an installer is able to utilize a short plastic spacer 200 in place of the prior art, and gain some of its advantages, without the requirement of changing any other aspect of the installer's other components or parts.

Figure 4:
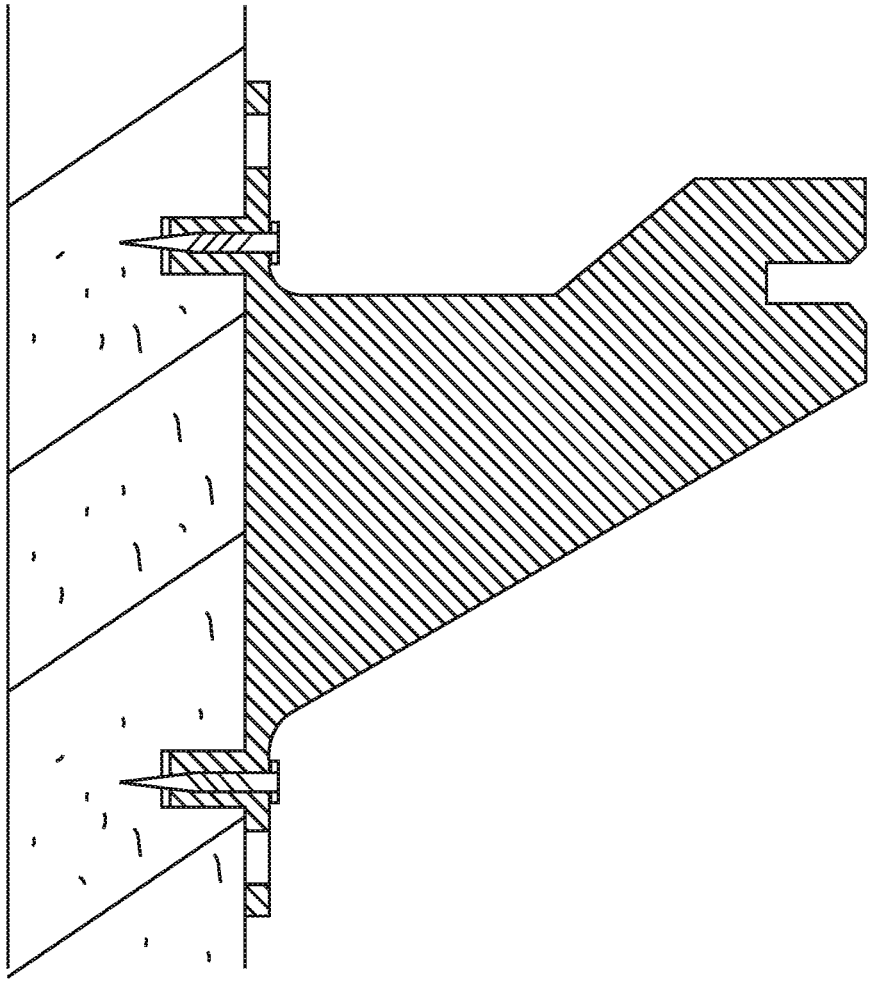
FIG. 4 is a cross-sectional view of a tall plastic spacer installed in a cabinet panel according to an embodiment of the disclosure.

FIG. 4 illustrates a tall cabinet spacer 100 installed in a cabinet side panel 315. As seen in FIG. 4, lug 27 is seated within a pre-drilled hole 318. Pin 33 drives through central bore 29, expanding the outer edges of the lug 27 into the pre-drilled hole 318. In some embodiments, pin 33 may extend beyond the end of the lug 27 and into the cabinet side panel 315.

Figure 5:
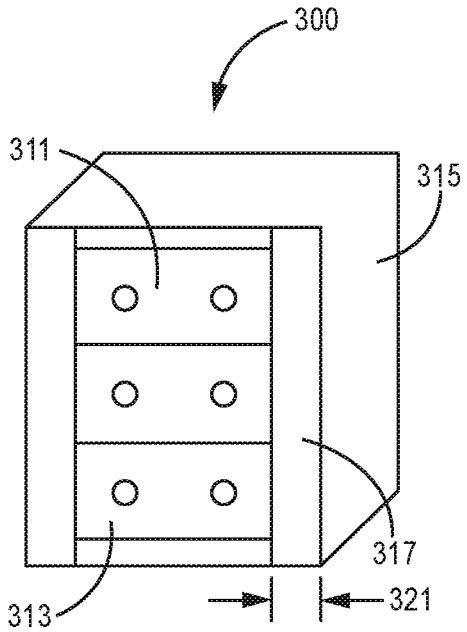
FIG. 5 is a perspective front view of a cabinet according to an embodiment of the disclosure.

FIG. 5 illustrates a cabinet 300 with a drawer 311. The cabinet has a cabinet side panel 315 and a cabinet front panel 317. When a drawer 315 is in a closed position, a drawer face panel 313 may be flush with cabinet front panel 317. Cabinet side panel 315 may be fixedly attached to cabinet front panel 317. Examples of fixed attachments for purposes of this disclosure may include any combination of welds, rivets, screws, nails, lugs, bolts, glue, and the like in addition to associated components such as washers or nuts. In embodiments, cabinet side panel 315 may be integral with cabinet front panel 317. In embodiments, cabinet front panel 317 may have an axial width 321 between 45 and 85 millimeters. In embodiments, cabinet front panel 321 may have an axial width generally corresponding to the height 16 of a plastic spacer 10.

In embodiments, panels (313, 315, 317) and drawers 311 may comprise wood or wood products, such as hardwood, engineered wood, oriented strand board, plywood, or particle board. In embodiments, panels (313, 315, 317) and drawers 311 may be formed of alumina, aluminum alloys, magnesium alloys, steel, or other sheet metals or alloys known to one skilled in the art. In embodiments, drawers and panels may be comprised of plastics or polymers. In embodiments, panels (313, 315, 317) and drawers 311 may include any combination of wood and metal products. For example, a cabinet side panel 315 may comprise a sheet of plywood with a layer of melamine.

Figure 6:
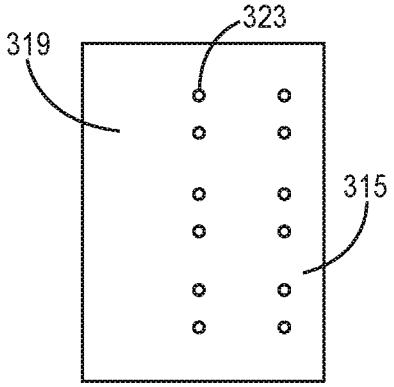
FIG. 6 is an interior surface of a cabinet side panel before installing spacers according to an embodiment of the disclosure.

FIG. 6 depicts an interior surface 319 of the cabinet side panel 315. A lug receptacle 323 is configured to receive lug 27. A cabinet panel may have as many lug receptacles 323 as required to match the number of lugs 27 in a plastic spacer 10. In embodiments, the lug receptacles 323 may be preformed to accommodate a variety of configurations, such that not all lug receptacles 323 are utilized in a single cabinet 300. This permits a cabinet side panel 315 to be prefabricated and used in a variety of cabinet 300 configurations.

Figure 7:
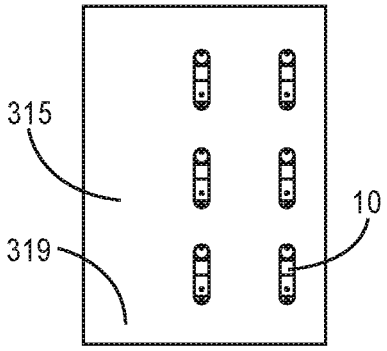
FIG. 7 is an interior surface of a cabinet side panel according to an embodiment of the disclosure with spacers installed.

FIG. 7 illustrates pairs of plastic spacers 10 aligned in horizontal rows on a cabinet side panel 315. In embodiments, additional plastic spacers 10 may be added to the horizontal rows as required. Additional spacers may offer load distribution and stability based on drawer 311 characteristics such as depth, width, and weight. More or fewer horizontal rows may be required based on the number of drawers 311 installed in cabinet 300.

Figure 8:
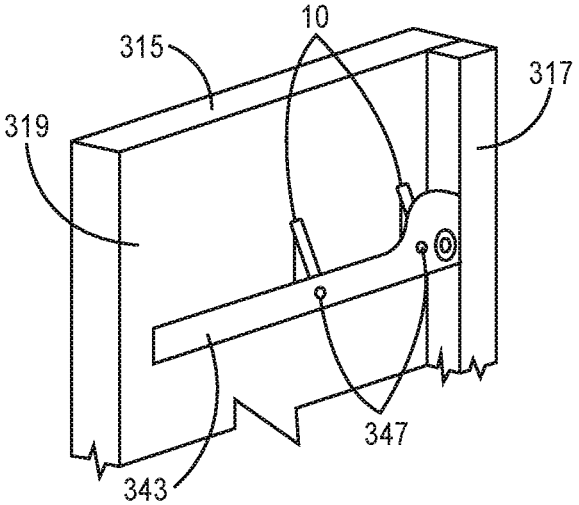
FIG. 8 is a partial perspective view of the interior of a cabinet side panel and a cabinet front panel according to an embodiment of the disclosure.
Figure 9:
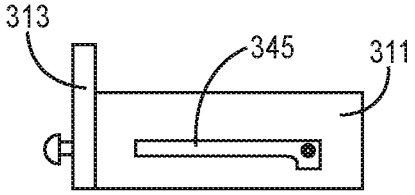
FIG. 9 is a side view of a drawer according to an embodiment of the disclosure.

FIG. 8 depicts a guide rail 343 fixedly attached to a pair of plastic spacers 10 along the interior surface 319 of cabinet side panel 315. For example, a slide mounting screw 347 may be used to secure the guide rail 343 to bore 47. Plastic spacer 10 creates separation between the cabinet side panel 15 and guide rail 343 that is generally equivalent to the axial width 321 of cabinet front panel 317. Guide rail 343 may be generally flush with cabinet front panel 317. In some embodiments, guide rail 343 may slightly overlap cabinet front panel 317. In embodiments, guide rail 343 may be fixedly attached to cabinet front panel 317. FIG. 9 illustrates a slide 345 affixed to the side of drawer 311. Slide 345 is configured to interface with guide rail 343 allowing drawer 311 to easily move within cabinet 300. When drawer 311 is fully inserted in cabinet 300, an outer surface of drawer face panel 313 should generally align with an outer surface of cabinet front panel 317.

Figure 10:
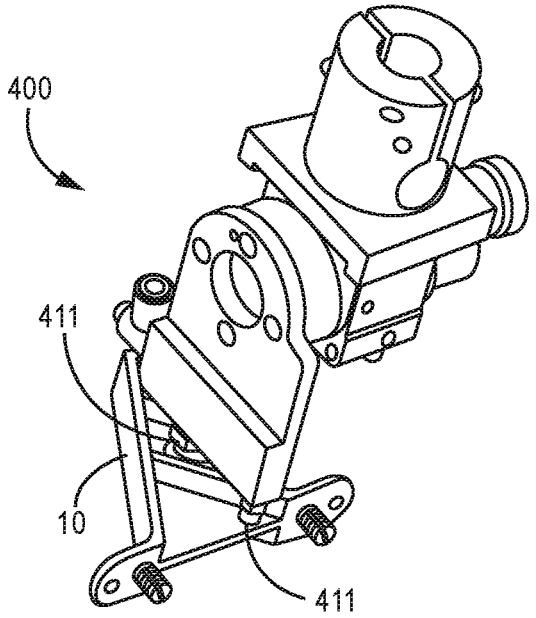
FIG. 10 is a perspective view of a picking tool according to an embodiment of the disclosure.

FIG. 10 illustrates a picking tool 400 that may be used to pick up and manipulate a plastic spacer 10. For example, picking tool 400 may have one or more pneumatic suction cups 411 configured to grasp the same side of the body portion 15 of a plastic spacer 10. The picking tool 400 may then rotate freely to orient the plastic spacer 10 into a desired position. The picking tool may be on a conventional industrial robot.

Figure 11:
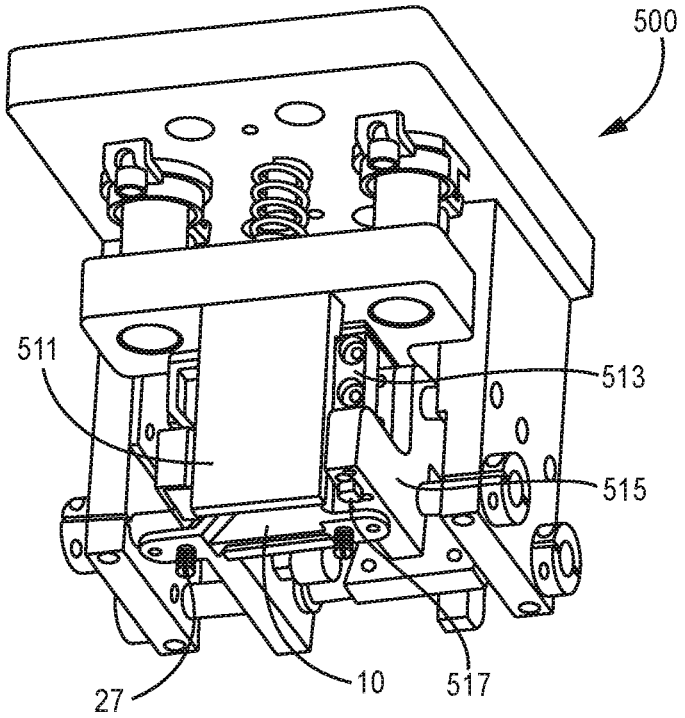
FIG. 11 is a bottom perspective view of a placing tool according to an embodiment of the disclosure.
Figure 13A:
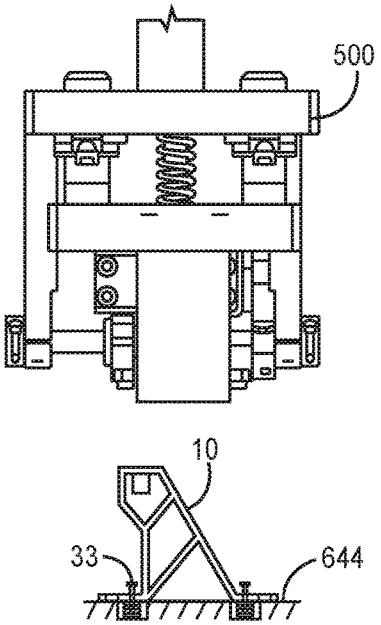
FIGS. 13A-13E is a front view of a spacer station assembly with assembly steps according to an embodiment of the disclosure.
Figure 13B:
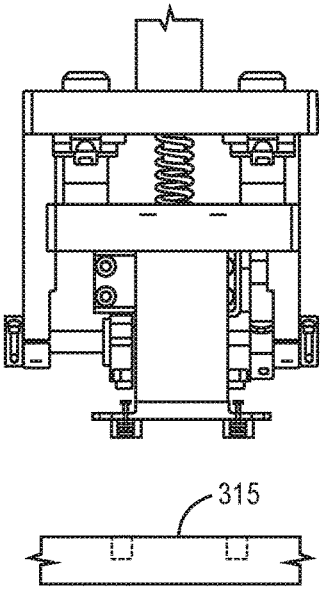
Figure 13C:
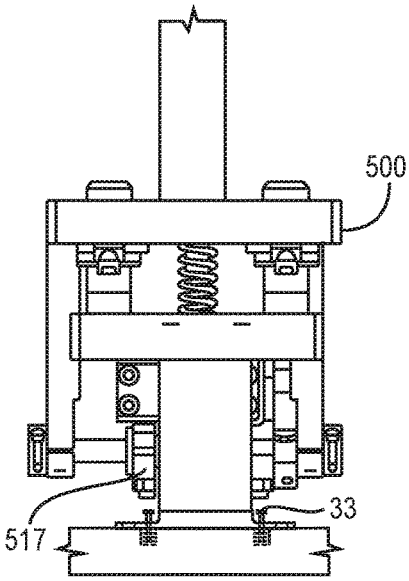
Figure 13D:
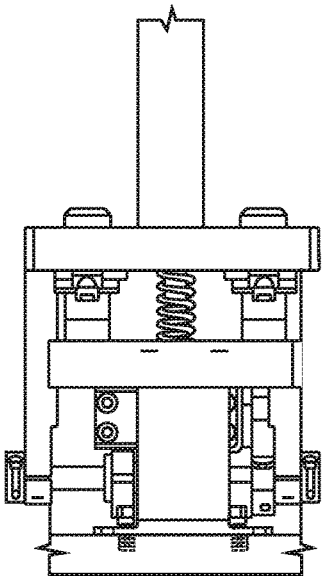
Figure 13E:
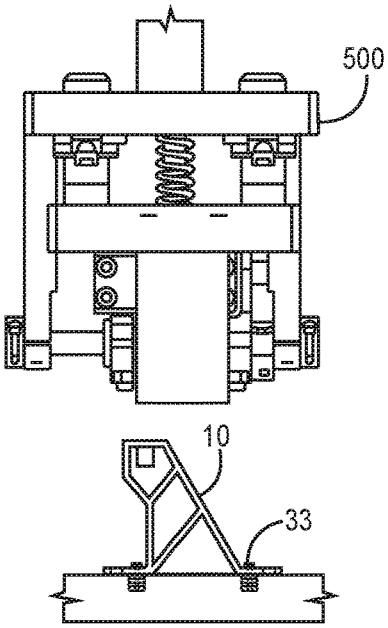

FIG. 11 depicts a placing tool 500 for installing a plastic spacer 10 in a cabinet side panel 315 in a single continuous motion or two motions. Placing tool 500 may secure the plastic spacer 10 between a front clamp 511 and a back clamp 513 (FIG. 13A). When a cabinet side panel 315 is placed beneath the placing tool 500 such that the lug receptacles 323 align with the lugs 27 (FIGS. 13B and 13C), the placing tool 500 may install the plastic spacer 10 in a single downward motion. The placing tool 500 lowers the plastic spacer 10 until the lugs 27 are inserted into the lug receptacles 323, and then the nail insertion block 515 continues lowering such that the nail head hammer portions 517 drives the pin 33 downward (FIG. 13D). Driving the pin 33 through the central bore 29 causes the ribbed surface 31 of the lug 27 to separate and engage with the lug receptacle 323, thereby securing the plastic spacer 10 in place. The pin 33 may also be driven into the cabinet side panel 315, further securing the plastic spacer 10 to the cabinet side panel 315. The placing tool 500 then releases the plastic spacer 10 and retracts (FIG. 13E). Additional fastening means are possible as well. In embodiments, an installer may use glue or similar adhesives in the receptacles 323 or along the cabinet panel contact face 11. In embodiments, an installer may insert additional fasteners through the apertures 25 in the cabinet panel contact face 11.

Figure 12:
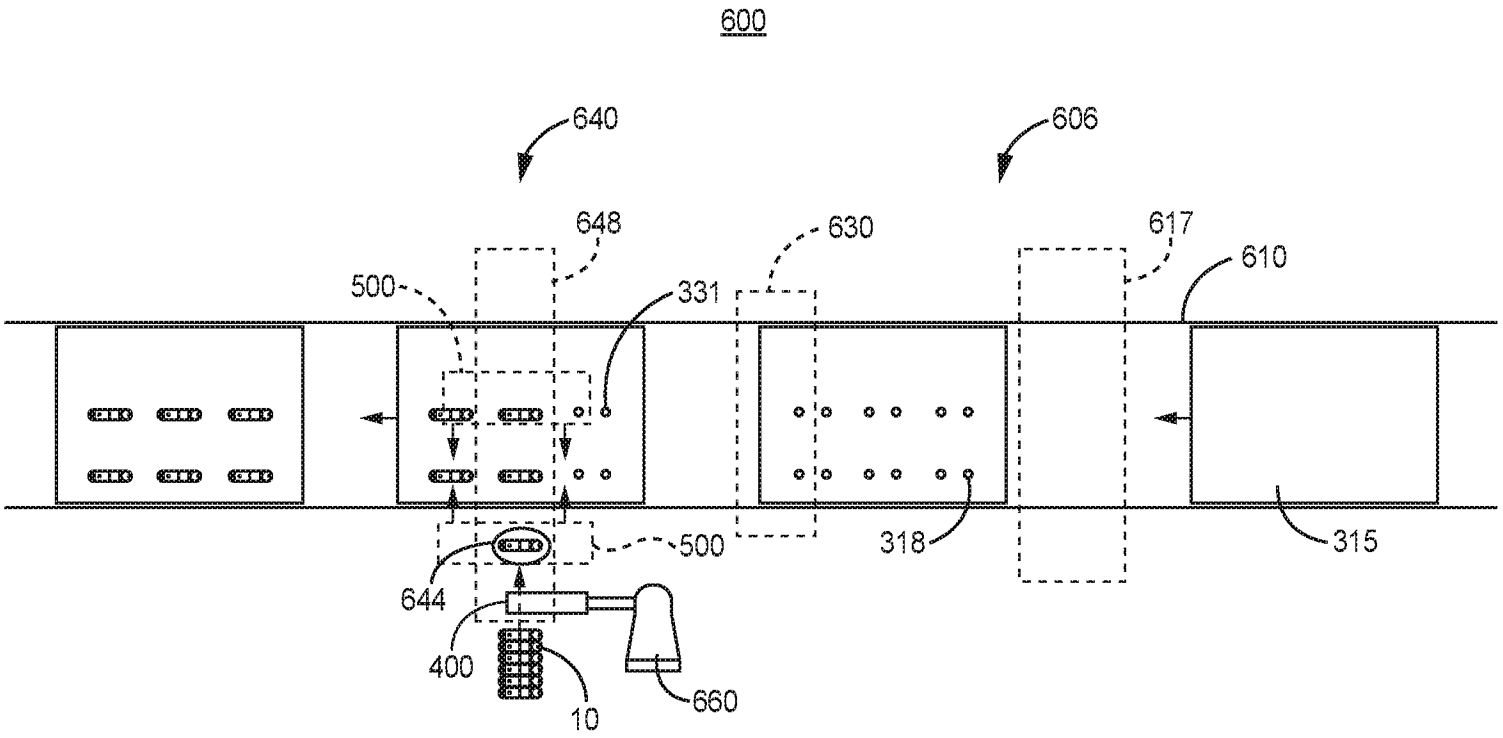
FIG. 12 is a partial perspective view of a manufacturing facility according to an embodiment of the disclosure.

Referring to FIGS. 12-13E details of an assembly process of the spacers into a cabinet side panel are illustrated. FIG. 12 shows part of a manufacturing facility 600 having an assembly line 606 for automated installation of plastic spacers 10. The assembly line may include a conveyor belt 610 that moves cabinet side panels 315 toward and through the processing stations. A drilling station 617 drills holes 318 into the cabinet side panel therebelow. A glue station 630 injects glue 631 into the holes 318 of the cabinet side panel therebelow. Referring also to FIGS. 13A-13E, a spacer install station 640 with a placing tool 500 clamps onto an individual spacer at a spacer pickup region 644, see FIG. 13A, the placing tool lifts the spacer by way of an translation means 648, such as tracks, and moves across the conveyor to an attachment position above the cabinet side panel 315, see FIG. 13B. The placing tool 500 lowers the spacer such that the spacer is flush on the surface of the side panel with the lugs seated in a pair of holes of the side panel, see FIG. 13C. The hammer portions 517 of the placing tool 500 then drives down the pins The placing tool then unclamps from the spacer, elevates and moves back to the spacer pick up region 644. Spacers are moved into the spacer pick up region such as by an industrial robot 660 with a picking tool 400 as shown in FIG. 10.

The following reference are incorporated herein for all purposes: US Pat. Pub. 2004/0224086.

For purposes of this disclosure, stated measurements or dimensions are accurate within 10% of the stated values. Similarly, measurements or dimensions stated to be "generally" or "about" a specific value are considered accurate within 10% of the stated value.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A furniture item comprising a drawer slide affixed to a cabinet panel, the drawer slide being offset from the cabinet panel by a spacer, the spacer comprising:

a body portion extending between a cabinet panel contact face and an opposite drawer slide contact face, the body portion having a perimeter flange with a sloped edge portion opposite an inset edge portion, a first flange tab unitary with the sloped edge portion, a second flange tab unitary with the inset edge portion defining a recess having three sides, the cabinet panel contact face on the first and second flange tabs;

a first lug extending orthogonally from the cabinet panel contact face of the body portion, the first lug seated in a corresponding recess in the cabinet panel;

a first pin extending through a central bore of the first lug and extending into the cabinet panel;

a second lug having a central bore extending orthogonally from the cabinet panel contact face of the body portion, the second lug seated in a corresponding recess in the cabinet panel;

a second pin extending through the central bore of the second lug and extending into the cabinet panel; and wherein the second flange tab defines an aperture within the recess defined by the inset edge portion through which the first pin is positioned, and the drawer slide contact face is secured to the drawer slide with a fastener.

2. The furniture item of claim 1, wherein the first lug and the second lug of the spacer are unitary with the first flange tab and the second flange tab respectively.

3. The furniture item of claim 1, wherein an angle between the sloped edge portion and the longitudinal axis of the cabinet panel contact face of the spacer is between 50 and 65 degrees.

4. The furniture item of claim 1, wherein the body portion of the spacer has a webbing extending between the sloped edge portion and the inset edge portion.

5. The furniture item of claim 1, wherein one or more gussets extend between the sloped edge portion and the inset edge portion of the spacer.

6. The furniture item of claim 1, wherein the body portion of the spacer has a boss extending inwardly at the perimeter flange, the boss having a bore extending to the drawer slide contact face, the fastener extending into the boss.

7. The furniture item of claim 1, wherein the cabinet panel contact face of the spacer at the first flange tab is coplanar with the cabinet panel contact face at the second flange tab.

8. The furniture item of claim 1, wherein one of the first flange tab and the second flange tab has an aperture distal to the first lug or the second lug for receiving a screw.

9. The furniture item of any claim 1, the second flange tab of the spacer has an aperture distal to the second lug for receiving a screw.

10. The furniture item of claim 1, wherein an axial length of the cabinet panel contact face of the spacer is between 80 and 120 millimeters.

11. The furniture item of claim 1, wherein the drawer slide contact face of the spacer is located on a line perpendicular to the cabinet panel contact face extending through the first pin in the first lug at the inset edge portion.

12. A furniture item comprising a cabinet portion with a plurality of stacked drawers therein, the cabinet formed of a pair of wood product side wall panels, a rear panel extending between the side wall panels, and a front panel with openings for receiving the plurality of stacked drawers;

wherein each of the plurality of stacked drawers having a pair of drawer slides attaching the respective drawer to the pair of side panels by way of a pair of polymer cantilever spacers, each drawer slide having a rail portion and a cooperating slide portion, the rail portions secured to the polymer cantilever spacers and the slide portion secured to the drawers;

wherein each of the polymer spacers has a panel engagement end and a rail engagement end, the spacer comprising a body portion extending between the panel engagement end and the rail engagement end, the spacer further comprising a pair of oppositely extending flange tabs unitary with the body portion at the panel engagement end of the spacer, the tabs each having a planar engagement surface in engagement with the interior surface of the side wall panel and each having a split ribbed lug portion extending in a direction away from the body portion, the split ribbed lug portions each having an axis extending in a direction perpendicular to the planar engagement surfaces, a central opening extending through the respective flange tab and into the split ribbed lug portion, an elongate metal expander pin in the opening, the split ribbed lug portion having a plurality of legs that are compressed between the elongate metal expander pin and an interior surface of the hole, thereby anchoring each lug into a hole and securing the spacer on the panel side wall;

wherein each of the polymer cantilever spacers is secured to the rail portion by a fastener extending through an aperture in the rail portion and into a corresponding bore in the rail engagement end of the polymer cantilever spacer.

13. The furniture item of claim 12, wherein there is cured glue in each of the holes in the pair of side wall panels.

14. The furniture item of claim 12, wherein the spacer body portion extending from the pair of oppositely extending flange tabs of each spacer is positioned below an axis of the respective split ribbed lug portions by at least 4 mm.

15. The furniture item of claim 12, wherein each spacer is connected to the respective side wall panel by only two connections.

16. The furniture item of claim 12, wherein each spacer is connected to the respective side wall panel by two connections utilizing lugs and a screw through an opening in a flange tab.

17. The furniture item of claim 16, wherein each of the expander pins has a space thereabove for hammering in the respective expander pin.

* * * * *